US009470023B2

(12) United States Patent
Bai

(10) Patent No.: US 9,470,023 B2
(45) Date of Patent: Oct. 18, 2016

(54) DIAGONAL DRAW BAR STRUCTURE HAVING MICRO VENTILATION FUNCTION

(71) Applicant: GUANGDONG KIN LONG HARDWARE PRODUCTS., LTD, Dongguan (CN)

(72) Inventor: Baokun Bai, Dongguan (CN)

(73) Assignee: GUANGDONG KIN LONG HARDWARE PRODUCTS CO., LTD, Dongguan (CN)

( * ) Notice: Subject to any disclaimer, the term of this patent is extended or adjusted under 35 U.S.C. 154(b) by 0 days.

(21) Appl. No.: 14/866,397

(22) Filed: Sep. 25, 2015

(65) Prior Publication Data

US 2016/0138308 A1 May 19, 2016

(30) Foreign Application Priority Data

Nov. 18, 2014 (CN) ..... 2014 1 0660642

(51) Int. Cl.

| | |
|---|---|
| ***E05B 15/02*** | (2006.01) |
| ***E05C 17/02*** | (2006.01) |
| ***E05D 15/30*** | (2006.01) |
| ***E05B 65/08*** | (2006.01) |
| ***E05C 19/00*** | (2006.01) |
| ***E06B 7/04*** | (2006.01) |
| *E05D 15/52* | (2006.01) |

(52) U.S. Cl.

CPC ..... *E05C 17/02* (2013.01); *E05B 65/0888* (2013.01); *E05C 19/00* (2013.01); *E05D 15/30* (2013.01); *E06B 7/04* (2013.01); *E05D 15/5205* (2013.01); *E05Y 2800/75* (2013.01); *E05Y 2900/148* (2013.01)

(58) Field of Classification Search

CPC ..... E05B 7/04; E05B 65/0888; E05D 15/30; E05D 15/5205; E05C 17/02; E05C 19/00; E05Y 2800/75

USPC ..... 312/325; 49/339, 246–249, 253; 16/368, 370, 371

See application file for complete search history.

(56) References Cited

U.S. PATENT DOCUMENTS

| | | | | | |
|---|---|---|---|---|---|
| 3,575,483 | A * | 4/1971 | Church | E06B 3/385 | 312/325 |
| 3,584,413 | A * | 6/1971 | Abrami | E06B 7/04 | 49/114 |
| 5,050,345 | A * | 9/1991 | Nakanishi | E05D 15/30 | 49/260 |
| 5,081,741 | A * | 1/1992 | Aumercier | E05D 15/30 | 16/238 |
| 2001/0013202 | A1* | 8/2001 | Nakanishi | E05D 15/30 | 49/250 |
| 2003/0213100 | A1* | 11/2003 | Brain | E05D 15/30 | 16/361 |
| 2005/0011049 | A1* | 1/2005 | Muir | E05D 15/30 | 16/366 |
| 2005/0223524 | A1* | 10/2005 | Muir | E05D 15/30 | 16/366 |
| 2006/0265957 | A1* | 11/2006 | Muir | E05D 15/44 | 49/345 |
| 2007/0289096 | A1* | 12/2007 | Zhang | E05D 5/125 | 16/273 |
| 2007/0289100 | A1* | 12/2007 | Lake | E05D 15/30 | 16/362 |
| 2008/0016781 | A1* | 1/2008 | Chung | E05F 11/28 | 49/445 |
| 2008/0155783 | A1* | 7/2008 | Doring | E05D 15/30 | 16/248 |
| 2008/0256874 | A1* | 10/2008 | Curtis | E05D 15/30 | 49/399 |
| 2009/0077897 | A1* | 3/2009 | Liang | E05D 7/0423 | 49/397 |
| 2010/0071269 | A1* | 3/2010 | Isley | E05D 11/1007 | 49/404 |
| 2011/0107678 | A1* | 5/2011 | Bauman | E05D 15/30 | 49/506 |
| 2013/0104458 | A1* | 5/2013 | Leung | E05C 17/28 | 49/13 |

* cited by examiner

*Primary Examiner* — Hanh V Tran
(74) *Attorney, Agent, or Firm* — Kagan Binder, PLLC

(57) ABSTRACT

A diagonal draw bar having a micro ventilation function includes a first lever, a second lever, a retaining lever, a spring, a latching member, and an actuating lever. The first lever defines a first rivet hole, a second rivet hole, and provides a positioning hook. The second lever defines a third rivet hole and connects with the first lever. The retaining lever defines a fourth rivet hole and connects with the retaining lever, the retaining lever defines a through hole. The spring is latched within the through hole. The latching member extends through the spring. The actuating lever is provided with a projection for pushing the latching member upward.

10 Claims, 6 Drawing Sheets

DIAGONAL DRAW BAR STRUCTURE HAVING MICRO VENTILATION FUNCTION

CROSS REFERENCE TO RELATED APPLICATIONS

This application claims priority under 35 U.S.C. §119(b) and 37 CFR 1.55 to Chinese application filed on Nov. 18, 2014, and having serial number 201410660642.4, wherein the entirety of said application is incorporated herein by reference.

FIELD OF THE INVENTION

The present disclosure relates to hardware fittings, and more particularly relates to a diagonal draw bar structure having a micro ventilation function.

BACKGROUND OF THE INVENTION

The open, close, and micro ventilation states of a window can be achieved by controlling a locking system and a micro ventilation system, thereby attaining a switch between the states of a large area open (in a high ventilation state) and a small area open (in a safety ventilation state).

Currently, in order to achieve the micro ventilation state, most of the diagonal draw bars in the market generally adopt its locking point matching structure to realize the micro ventilation state. Therefore, a requirement of a conventional stroke of the whole system is extremely high. However, instability of the stroke can directly influence the implement of the micro ventilation state.

SUMMARY OF THE INVENTION

Therefore, it is necessary to provide a diagonal draw bar having a micro ventilation function to overcome above shortcomings.

A diagonal draw bar having a micro ventilation function includes a first lever, a second lever, a retaining lever, a spring, a latching member, and an actuating lever. The first lever defines a first rivet hole at an end thereof and is provided with a positioning hook at the other end thereof, the first lever further defines a second rivet hole on the positioning hook. The second lever defines a third rivet hole at an end thereof, the second lever is connected to the first lever by a first rivet riveted to the first rivet hole and extending through the third rivet hole. The retaining lever defines a fourth rivet hole at an end thereof, the retaining lever is connected to the first lever by a second rivet riveted to the second rivet hole and extending through the fourth rivet hole, the retaining lever defines a through hole at a position corresponding to the positioning hook. The spring latched within the through hole. The latching member extends through the spring. The actuating lever has a projection. By moving the actuating lever, the projection pushes the latching member upward, and the latching member latches with the positioning hook.

In the present diagonal draw bar structure having a micro ventilation function, the positioning hook is provided at an end of the first lever, the latching member is pushed upward, enabling the latching member to latch with the positioning hook, and then the rotation angle of the first lever is limited, realizing a micro ventilation state of the door and windows. It can be seen that, in the present solution, an enhancement of a stroke distance is no need, on basis of ensuring a positioning accuracy, the original structure, such as the locking point structure, can be remain the same.

BRIEF DESCRIPTION OF THE DRAWINGS

These and other features of the present invention will become readily apparent upon further review of the following specification and drawings. In the drawings, like reference numerals designate corresponding parts throughout the views. Moreover, components in the drawings are not necessarily drawn to scale, the emphasis instead being placed upon clearly illustrating the principles of the present disclosure.

DETAILED DESCRIPTION OF THE EMBODIMENTS

Figure 1:
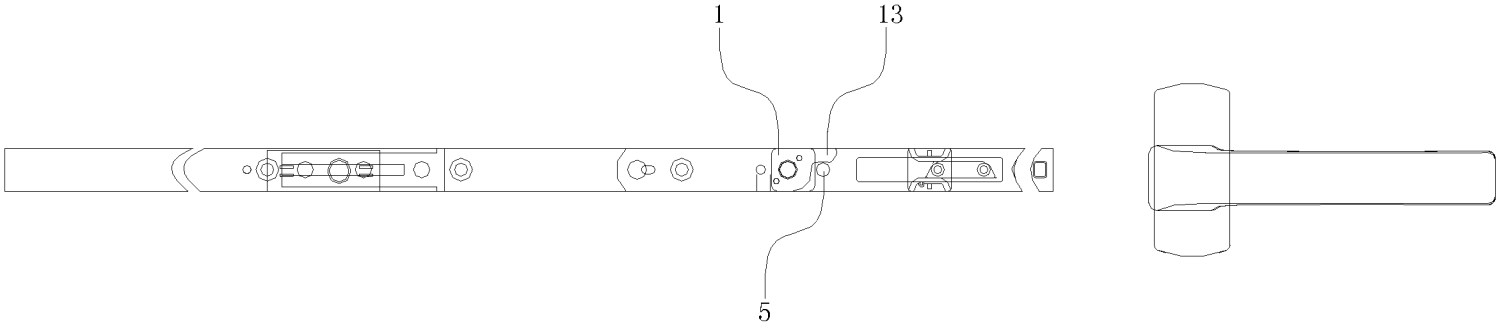
FIG. 1 is a schematic view of a diagonal draw bar structure having a micro ventilation function in an original state according to an embodiment.
Figure 2:
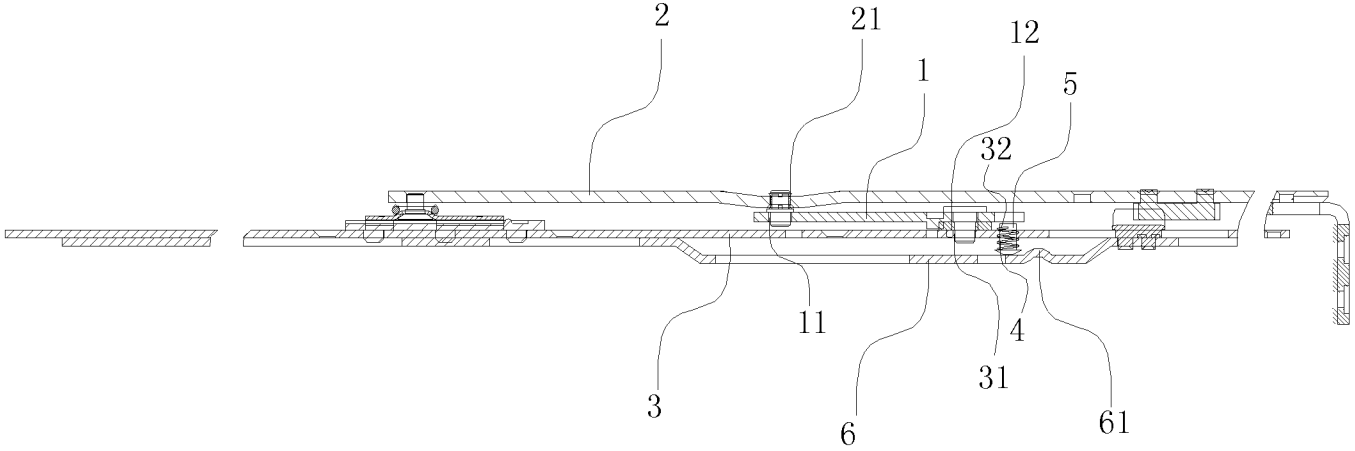
FIG. 2 is a sectional view of the diagonal draw bar structure having a micro ventilation function of FIG. 1.
Figure 3:
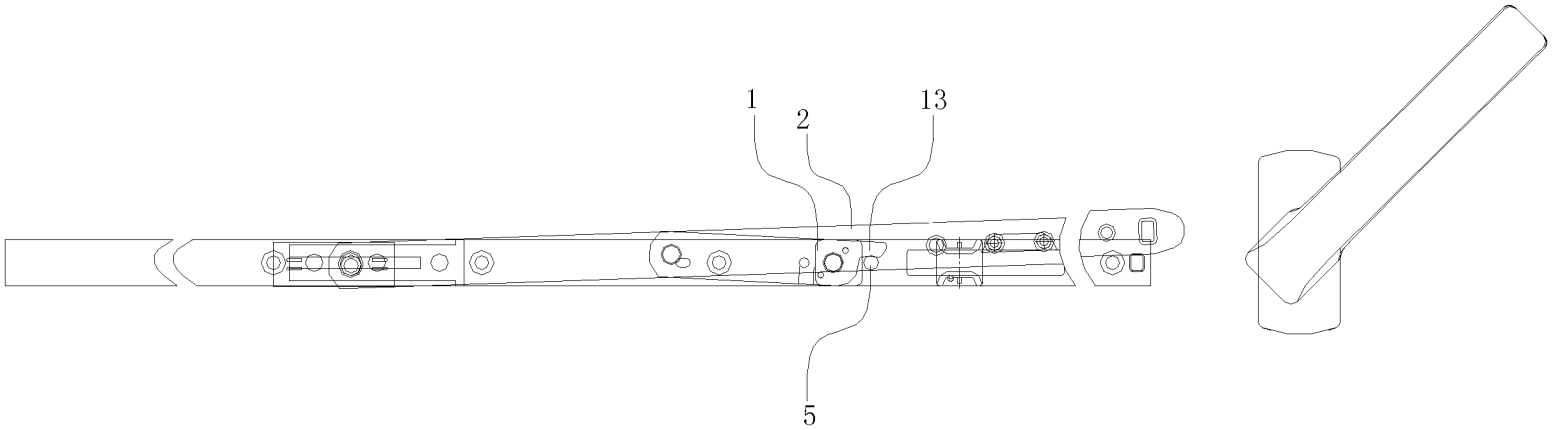
FIG. 3 is a schematic view of a diagonal draw bar structure having a micro ventilation function in a micro ventilation state according to an embodiment.
Figure 4:
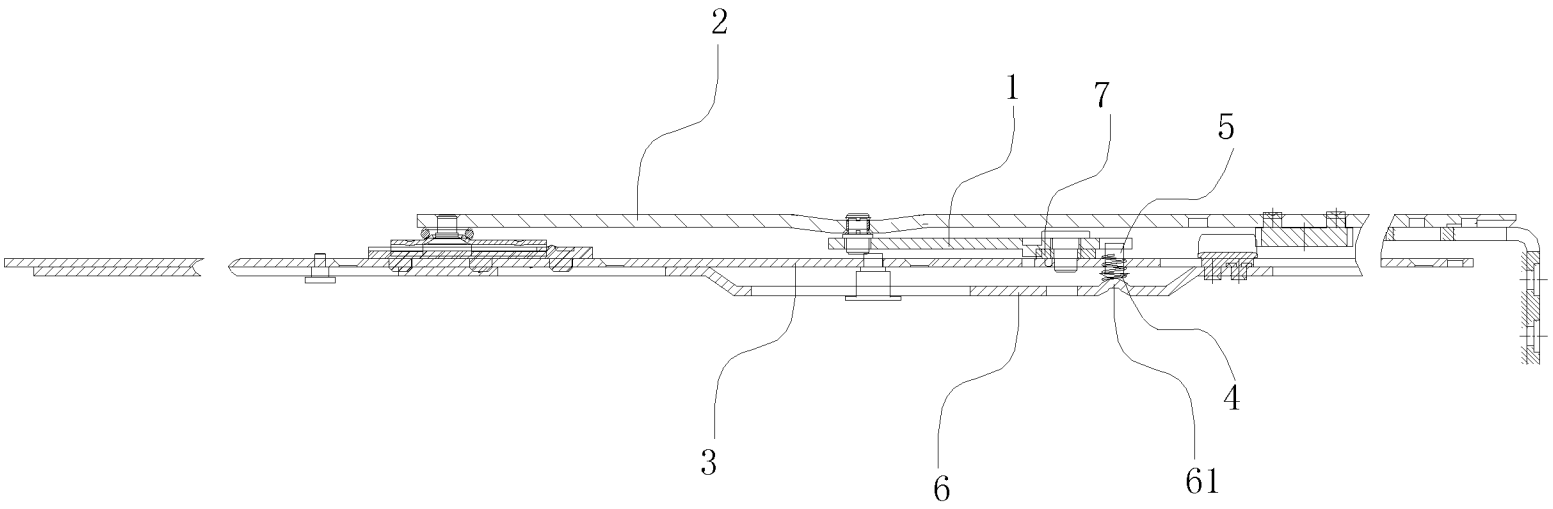
FIG. 4 is a sectional view of the diagonal draw bar structure having a micro ventilation function of FIG. 3.
Figure 5:
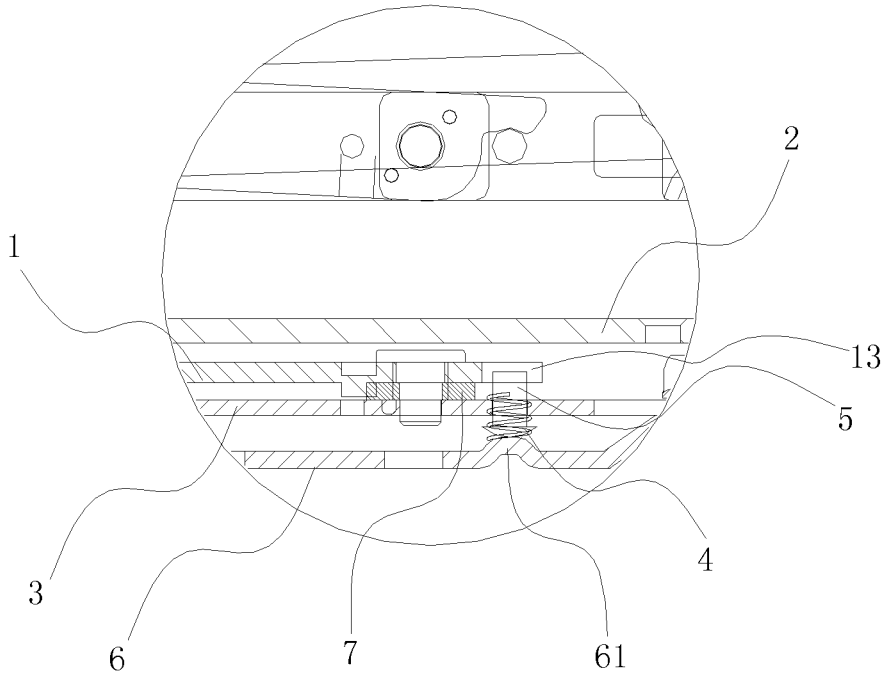
FIG. 5 is a partial, enlarged view of the diagonal draw bar structure having a micro ventilation function of FIG. 3.

Embodiments of the invention are described more fully hereinafter with reference to the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art. Elements that are identified using the same or similar reference characters refer to the same or similar elements.

It will be understood that when an element is referred to as being "connected" or "coupled" to another element, it can be directly connected or coupled to the other element or intervening elements may be present. In contrast, if an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein With reference to FIGS. 1 through 5, in an embodiment, the diagonal draw bar having a micro ventilation function includes a first lever 1, a second lever 2, a retaining lever 3, a spring 4, a latching member 5, and an actuating lever 6.

The first lever 1 is shorter than other levers, and provides a supporting function. The first lever 1 defines a first rivet hole 11 and a second rivet hole 12 at opposite ends thereof. Specifically, an end of the first lever 1 extends outward to form a positioning hook 13. An end of the first lever 1 has a revolved side which has an irregular contour. Further, the second rivet hole 12 is defined on an inner side of the positioning hook 13. The first lever 1 can rotate and enable the positioning hook 13 to easily latch with the latching member 5. It can be understood that, the second rivet hole 12 can also be located at an outer side of the positioning hook 13, in that case, the positioning hook 13 is a notch (not shown), when the first lever 1 rotates, the positioning hook 13 latches with the latching member 15.

The second lever 2 is positioned on a top of the first lever 1, opposite ends of the second lever 2 are connected to other accessories. The second lever 2 defines a third rivet hole 21 and is riveted to the first lever 1 by a rivet extending through the third rivet hole 21 and the first rivet hole 11 to.

The retaining lever 3 is positioned on a bottom of the first lever 1, opposite ends of the retaining lever 3 are connected to other bars. The retaining lever 3 defines a fourth rivet hole 31 at a side. The retaining lever 3 is riveted to the first lever 1 by a rivet extending through the second rivet hole 12 and the fourth rivet hole 31. In addition, the retaining lever 3 defines a through hole 32 at a position corresponding to the positioning hook 13, facilitating for the latching member 5 to extend through the through hole 32 and to reach the positioning hook 13.

The spring 4 is latched within the through hole 32.

The latching member 5 extends through the spring 4 and is connected to the spring 4. Specifically, the latching member 5 inserts into the spring 4 and is sleeved by the spring 4, an end of the spring 4 is connected to the latching member 5, the other end of the spring 4 is connected to the through hole 32. In the embodiment, the latching member 5 is a locating pin, and a bottom of the locating pin (i.e. the head cap of the locating pin) is a circular cap shape and opposite to the first lever 1. An end of the spring 4 is connected to the circular cap, the other end of the spring 4 is latched within the through hole 32 of the retaining lever 3.

The actuating lever 6 is located at a bottom of the diagonal draw bar and includes a projection 61 toward the retaining lever 3. When the actuating lever 6 is moved (rotated), the projection 61 pushes the latching member 5 upward, the latching member 5 compresses the spring 4 and latches with the positioning hook 13. In other embodiments, the projection 61 is in an arc-shape. The projection 61 moves and pushes the latching member 5 upward, the contact surface is a circular smooth surface, enabling the push procedure more smoothly. It can be understood, a groove of the positioning hook 13 is positioned close to outside or inside of the positioning hook 13, providing an adjustment of a swinging angle of the first lever 1. In addition, the positioning hook 13 can be a telescopic elastic positioning hook 13, the position of the positioning hook 13 is adjusted according to a requirement, thus allowing an adjustment of the swing angle of the first lever 1.

The diagonal draw bar structure having a micro ventilation function includes a positioning hook 13 at an end of the first lever 1, such that the latching member 5 can latch with the positioning hook 13, and then the rotation angle of the first lever 1 is limited, realizing a micro ventilation state of the door and windows. In addition, the structures of the positioning hook 13 and the latching member 5 are simple, the machining and installing thereof are much more convenient.

Comparing to the micro ventilation structure of the conventional diagonal draw bar, the conventional method needs to modify the locking point structure of the diagonal draw bar, the present solution does no need to modify the original locking point structure, and at the same time, the system transmission error can be effectively avoided.

In another embodiment, the spring 4 has two configurations: the spring 4 is located on a side of the actuating lever 6, or the spring 4 is positioned on a side same as the first lever 1. Specifically, the detail is illustrated as follows:

When the spring 4 is positioned on a side of the actuating lever 6, in an original state, the spring 4 and the latching member 5 are in a dynamic balance state, at the time, the latching member 5 does not latch with the positioning hook 13. The lever handle is rotated, the actuating lever 6 is moved, the projection 61 pushes the latching member 5 upward, the latching member 5 compresses the spring 4 and latches with the positioning hook 13. When the actuating lever 6 is pulled back, the projection 61 departs from the latching member 5, the latching member 5 is exerted by the restoring force of the spring 4 and returns to the original state, the latching between the latching member 5 and the positioning hook 13 is released.

When the spring 4 is positioned on the side same as the first lever 1, i.e. the spring 4 is located between the first lever 1 and the retaining lever 3. In the original state, the spring 4 and the latching member 5 are in a dynamic balance state. At the same time, the latching member 5 does not latch with the positioning hook 13. When the lever handle is rotated, the actuating lever 6 is moved, the projection 61 pushes the latching member 5 upward, the latching member 5 compresses the spring 4 and latches with the positioning hook 13. When the actuating lever 6 is pulled back, the projection 61 departs from the latching member 5, the latching member 5 is exerted by the restoring force of the spring 4 and returns to the original state, the latching between the latching member 5 and the positioning hook 13 is released.

In an embodiment, the diagonal draw bar structure having a micro ventilation function further includes a positioning block 7 fixed to the retaining lever 3. The positioning block 7 is located between the fourth rivet hole 31 of the retaining lever 3 and the second rivet hole 12 of the first lever 1. A rivet extends through the second rivet hole 12, the positioning block 7, and the fourth rivet hole 31, providing a stable connection and positioning function for the first lever 1 and the retaining lever 3.

Figure 6:
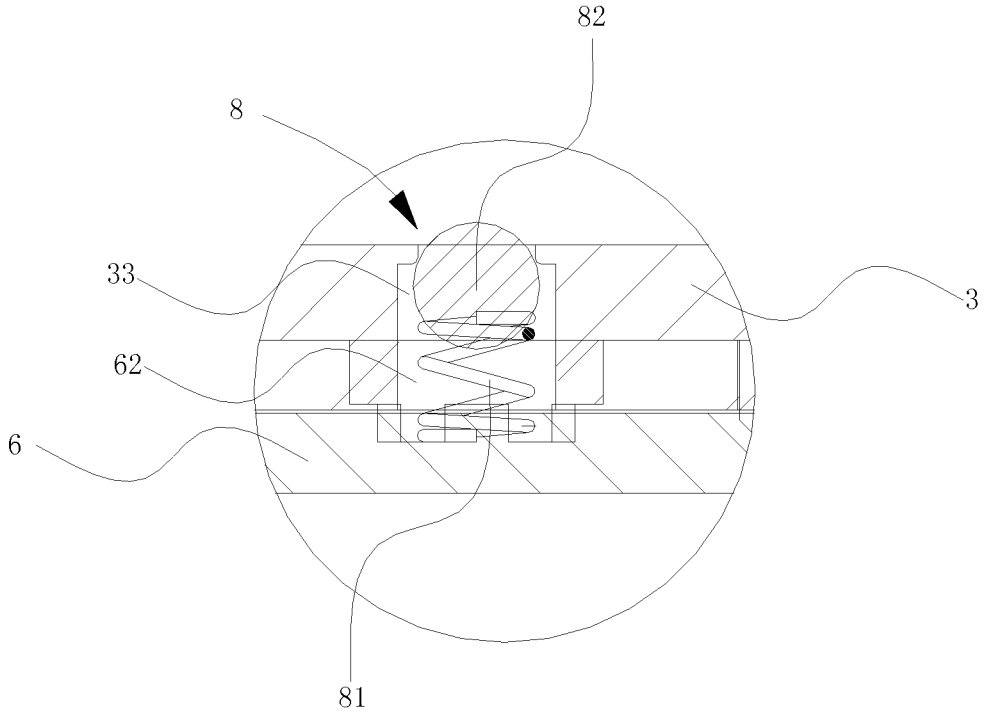
FIG. 6 is a schematic view of a positioning member according to an embodiment.

In another embodiment, referring to FIG. 6, the diagonal draw bar structure having a micro ventilation function further includes a positioning member 8. The retaining lever 3 defines a positioning hole 33. The actuating member 6 is moved, the positioning member 8 latches with the positioning hole 32, realizing a positioning function.

Specifically, the positioning member 8 includes a positioning spring 81, and a positioning ball 82. The actuating lever 6 defines a stepped through-hole 62, the positioning spring 81 is placed within the stepped through-hole 62. The positioning ball 82 is positioned in the stepped through-hole 62 and elastically resists the positioning spring 81. The actuating lever 6 is moved, the positioning ball 82 moves to the positioning hole 33, and latches with the positioning hole 33. A stroke distance of the positioning member 8 moving to the positioning hole 33 is equal to a stroke distance of the projection 61 moving to the latching member 5, ensuring a positioning accuracy.

In the embodiment, in order to ensure a stroke trace of the positioning ball 82 not to deviate from the retaining lever 3. The retaining lever 3 may define a guiding groove at a bottom, for leading the positioning ball 82 to move. In addition, the positioning ball 82 can be a steel ball, thus prolonging a service life of the positioning member.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. A diagonal draw bar having a micro ventilation function, comprising:

a first lever defining a first rivet hole at an end thereof and being provided with a positioning hook at the other end thereof, the first lever further defining a second rivet hole on the positioning hook;

a second lever defining a third rivet hole at an end thereof, the second lever being connected to the first lever by a first rivet riveted to the first rivet hole and extending through the third rivet hole;

a retaining lever defining a fourth rivet hole at an end thereof, the retaining lever being connected to the first lever by a second rivet riveted to the second rivet hole and extending through the fourth rivet hole, the retaining lever defining a through hole at a position corresponding to the positioning hook;

a spring latched within the through hole;

a latching member extending through the spring; and an actuating lever having a projection;

wherein by moving the actuating lever, the projection pushes the latching member upward, and the latching member latches with the positioning hook.

2. The diagonal draw bar according to claim 1, wherein the spring is positioned on a side of the retaining lever away from the first lever, and is compressed by the latching member when the projection pushes the latching member upward.

3. The diagonal draw bar according to claim 1, wherein the spring is positioned between the retaining lever and the first lever, and is compressed by the latching member when the projection pushes the latching member upward.

4. The diagonal draw bar according to claim 2, further comprising a positioning block fixed to the retaining lever, wherein the positioning block is positioned between the fourth rivet hole of the retaining lever and the second rivet hole of the first lever.

5. The diagonal draw bar according to claim 1, wherein the latching member is a locating pin.

6. The diagonal draw bar according to claim 5, wherein a bottom of the latching member is in a circular cap shape, the projection is in an arc-shape.

7. The diagonal draw bar according to claim 4, wherein an end of the first lever has a revolved side, the revolved side has an irregular contour.

8. The diagonal draw bar according to claim 1, further comprising a positioning member, wherein the retaining lever defines a positioning hole, when the actuating member is moved, the positioning member latches with the positioning hole to position the actuating member on the retaining lever.

9. The diagonal draw bar according to claim 8, wherein the positioning member comprises a positioning spring and a positioning ball, the actuating lever defines a stepped through-hole, the positioning spring is placed within the stepped through-hole, the positioning ball is positioned in the stepped through-hole and elastically resists the positioning spring.

10. The diagonal draw bar according to claim 9, wherein the positioning ball latches with the positioning hole, a stroke distance of the positioning member moving to the positioning hole is equal to a stroke distance of the projection moving to the latching member.

* * * * *